US005120933A

United States Patent [19]

Altamore et al.

[11] Patent Number: 5,120,933

[45] Date of Patent: * Jun. 9, 1992

[54] CURLING IRON HAVING FLATTENED HEATING TUBE AND DEPRESSIONS IN SELECTED SURFACES

[75] Inventors: Nicolo Altamore, Rockford; Gregory S. Wahl, Sterling, both of Ill.

[73] Assignee: Wahl Clipper Corporation, Sterling, Ill.

[ * ] Notice: The portion of the term of this patent subsequent to Sep. 12, 2006 has been disclaimed.

[21] Appl. No.: 224,806

[22] Filed: Jul. 27, 1988

Related U.S. Application Data

[63] Continuation-in-part of Ser. No. 51,944, May 19, 1987.

[51] Int. Cl.[5] ..... A45D 1/04; A45D 2/12; H05B 3/00

[52] U.S. Cl. ..... 219/225; 132/229; 132/232; 219/230

[58] Field of Search ..... 219/222-226, 219/230; 132/229, 232, 231, 234, 233, 237

[56] References Cited

U.S. PATENT DOCUMENTS

| | | | |
|---|---|---|---|
| D. 253,254 | 10/1979 | Cusenza | D28/35 |
| D. 256,169 | 7/1980 | Cusenza | D28/35 |
| D. 281,823 | 12/1985 | Sherman . | |
| 364,956 | 6/1887 | Posner . | |
| 379,443 | 3/1888 | Bissell . | |
| 459,146 | 9/1891 | Nicol, Jr. . | |
| 536,802 | 4/1895 | Harris . | |
| 542,216 | 7/1895 | Allen . | |
| 681,827 | 9/1901 | Jackson . | |
| 861,596 | 7/1907 | Machado . | |
| 866,778 | 9/1907 | Eldridge . | |

(List continued on next page.)

FOREIGN PATENT DOCUMENTS

| | | |
|---|---|---|
| 592707 | 7/1960 | Belgium . |
| 787814 | 12/1972 | Belgium . |
| D38998 | 3/1975 | Canada . |
| D40144 | 1/1976 | Canada . |
| D48414 | 7/1981 | Canada . |
| D48415 | 7/1981 | Canada . |
| 21941 | 6/1980 | European Pat. Off. . |
| 185989 | 3/1906 | Fed. Rep. of Germany . |
| 3302237 | 7/1984 | Fed. Rep. of Germany . |
| 589572 | 2/1925 | France . |
| 1005438 | 12/1951 | France . |
| 1368924 | 6/1964 | France . |
| 1379083 | 10/1964 | France . |
| 2513497 | 9/1982 | France . |
| 233070 | 2/1986 | German Democratic Rep. . |
| 225941 | 12/1924 | United Kingdom . |
| 697773 | 9/1953 | United Kingdom . |
| 2021943 | 3/1979 | United Kingdom . |

OTHER PUBLICATIONS

Modern Salon, Dec., 1977, p. 58, "Special Pointers for Party Pizazz".

*Primary Examiner*—Anthony Bartis
*Attorney, Agent, or Firm*—Welsh & Katz, Ltd.

[57] ABSTRACT

A curling iron has an elongated heating tube and a clamp secured to an end of the tube which is attached to a handle. The heating tube has at least one generally flat surface having a longitudinal depression between 0.003 and 0.008 inch deep generally in the center of the surface. In one embodiment, the tube has relatively wide top and bottom surfaces which each have such a depression, and relatively narrow, sharply rounded side surfaces having a radius between about 0.03 and 0.1 inch. The clamp has a relatively short clamping surface which extends over a portion of the length of the heating tube. Hair strands which are wrapped around the tube are not curled over the flat surface or surfaces of the tube. The depressed portions of the heating tube do not contact the straight lengths of the hair directly, so that the straight lengths absorb less heat from the tube, and normal operating temperatures are more easily preserved in the heating tube.

7 Claims, 2 Drawing Sheets

U.S. PATENT DOCUMENTS 1,056,987 3/1913 Gough .
1,117,021 11/1914 Frey .
1,377,655 5/1921 Begas .
1,397,332 11/1921 Russell .
1,403,512 1/1922 Mariner .
1,455,696 5/1923 Wright .
1,491,415 4/1924 Pegelow .
1,510,359 9/1924 Van Gale .
1,553,342 9/1925 Vaughan .
1,580,370 4/1926 Dondanville et al. .
1,607,076 11/1926 Hamilton .
1,623,630 4/1927 Martin et al. .
1,637,893 8/1927 Beskow .
4,027,684 6/1977 Mueller .
4,034,201 7/1977 Walter et al. ..... 219/222 X
4,151,850 5/1979 Nathe et al. ..... 219/225 X
4,164,952 8/1979 Banks, Jr. .
4,209,685 6/1980 Walter et al. ..... 219/225
4,211,245 7/1980 Coppola et al. .
4,214,597 7/1980 Glassman .
4,227,541 10/1980 Satchell ..... 219/225
4,261,375 4/1981 Anderson .
4,289,151 9/1981 Pope .
4,354,482 10/1982 Beisecker .
4,426,567 1/1984 Gugliotti ..... 219/225
4,464,562 8/1984 Takimae ..... 219/225
4,479,047 10/1984 Khaja et al. ..... 219/225

CURLING IRON HAVING FLATTENED HEATING TUBE AND DEPRESSIONS IN SELECTED SURFACES

This is a continuation-in-part of Ser. No. 51,944, filed May 19, 1987, now U.S. Pat. No. 4,866,248.

BACKGROUND OF THE INVENTION

This invention relates to curling irons, and more particularly to curling irons having a heating tube which has a flattened oval shape with depressions in selected surfaces.

Many devices are available for curling a person's hair by wrapping a tuft of hair strands around a heated cylindrical tube, and transferring heat from the tube to the hair. Commercially available curling irons often include such a tube secured to a handle, and a heating element inside the tube. A clamp extends along substantially the entire length of the tube.

The ends of the hair strands are grasped between the tube and the clamp and the hair strands are wrapped around the tube and over the clamp by twisting the iron. Heat which is transferred from the tube to the hair causes the hair to retain a spiral shaped curl when the clamp is released and the curling iron is removed. The shape and resiliency of the curls are determined to a significant degree by the temperature of the hair, the length of time that heat is applied to the hair, and the radius of the tube.

Optimum curling of hair strands occurs when the heating tube is at its selected operating temperature. When the tube is at its operating temperature, it stores heat energy which is used to curl the hair. The heating element restores heat energy to the tube as heat is absorbed by the hair and clamp or dissipates. However, as the curling iron heats hair strands to create curls, the absorption of heat by the hair strands cools the heating tube somewhat, especially since the tube is round and the hair strands absorb heat around the entire circumference of the tube. The drop in temperature is dependent in part on the amount of heat energy which the tube can store, and the amount of heat which the hair absorbs.

This cooling effect is undesirable because curls made when the heating tube is at a lower temperature take longer to make, and curls created at the lower temperature are not as sharply defined and resilient as curls made at the selected operating temperature, unless the length of time that heat is applied to the hair is increased. The thermal capacitance, or ability of the heating tube to maintain its operating temperature, can be increased by increasing the mass of the tube, but that can make the tube undesirably large or heavy. Positive temperature coefficient PTC thermistors, which can be used in heating the tube, provide improved heat recovery, but are relatively expensive and difficult to insulate and install in the tube, and may not reach a sufficiently high temperature for many applications. The operating temperature of the tube can be increased to store additional heat energy in the tube, but a higher temperature can be impractical and even dangerous under some circumstances. Thus, there is a need for curling irons which more effectively maintain the heating tube at or near its selected operating temperature.

Since the heating tubes just described are round, the entire hair strand is heated and curled, which requires substantial heat energy from the curling iron. Moreover, heat is not transmitted efficiently to the outside layers of hair surrounding the tube, because the hair strands are wrapped over the clamp, and much of the hair is wrapped upon itself. Thus, heat transfer to the outer layers of hair is reduced because the entire hair strands are heated, and the outer layers are not in direct contact with the heating iron tube. Heat transfer to those portions of the hair to be curled is also reduced because the clamp absorbs heat energy. Thus, there is a need for curling irons in which heat transfer to those portions of the hair to be curled is improved because the hair is not wrapped over the clamp or upon itself.

Curling irons with round tubes form substantially round, spiral-shaped curls. Such irons are not used to produce other types of new and interesting curls, including Z-shaped curls, as well as other types, which have a different appearance. Thus, there is a need for curling irons which form Z-shaped curls and curls having other new and interesting shapes.

Accordingly, one object of this invention is to provide new and improved curling irons for hair.

Another object is to provide new and improved curling irons which provide increased heat transfer to those portions of the hair to be curled by reducing the length of the clamp.

Still another object is to provide new and improved curling irons which better maintain the heating tube at a desirable temperature as curls are created by increasing the heat energy transferred to portions of the hair strands which are actually curled, and decreasing the transfer of heat energy to portions of the hair strands which are not curled.

Yet another object is to provide new and improved curling irons which utilize energy efficiently.

SUMMARY OF THE INVENTION

In keeping with one aspect of this invention, apparatus for curling hair includes a handle, a generally cylindrical heating tube secured to the handle, and means for heating the tube. The heating tube has at least one generally flat surface having a longitudinal depression generally in the center of the surface. In one embodiment, the tube has relatively wide, spaced first and second surfaces which each have such a depression and are joined at their ends by relatively narrow, sharply rounded side surfaces. The flattened shape of the tube forms the hair in Z-shaped curls which have generally straight sections joined by sharp curves. The generally straight sections of hair pass over the depressions in the first and second surfaces and do not contact the heating tube directly, absorbing heat from the tube and lowering its temperature unnecessarily. Thus, only those portions of the hair strands which are actually curled absorb heat directly from the heating tube, conserving heat in the tube and maintaining the tube at a high temperature.

A clamp is movably secured to the curling iron. The clamp may extend over only a portion of the tube adjacent the handle, however, so that the ends of hair strands may be clamped near the handle, and those portions of the hair to be curled may be wrapped in substantially direct contact with the tube. In addition, the clamp preferably lies over the depression in the tube without contacting the depression so that the clamp absorbs less heat. Also, less heat is dissipated by reducing the length of the clamp or otherwise reducing the contact area of the clamp to the tube and the hair.

BRIEF DESCRIPTION OF THE DRAWINGS

The above-mentioned and other features of this invention and the manner of obtaining them will become more apparent and the invention itself will be best understood by reference to the following description, taken in conjunction with the accompanying drawings, in which.

DETAILED DESCRIPTION

Figure 1:
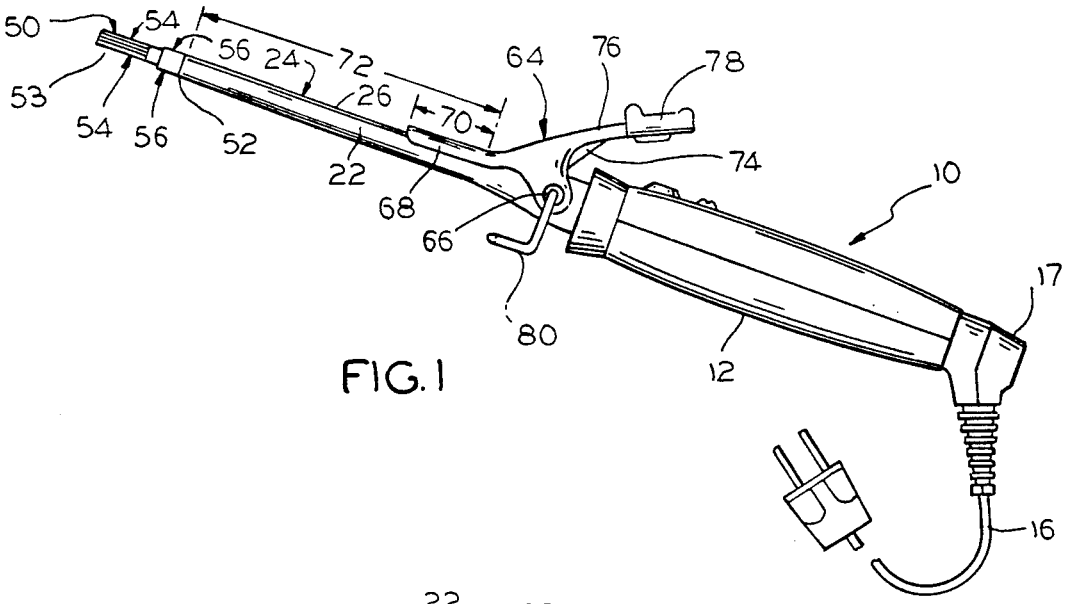
FIG. 1 is a side elevation view of a curling iron made in accordance with the invention.

As seen in FIG. 1, a curling iron 10 includes a handle 12, a heating element 14 secured to the handle 12, and an electric cord 16 for providing energy to the heating element 14. The cord 16 may be secured to the handle 12 by a rotatable connection 17, so that the iron may be rotated without unduly twisting the cord 16.

The handle 12 may be any suitable construction which provides sufficient thermal and electrical insulation from the heating element 14 so that the iron 10 can be held in an operator's hand for extended periods during use, without substantial discomfort. Suggested materials include heat resistant plastic. Added heat insulation may be realized by providing a second heat-resistant plastic piece (not shown) inside the handle 12. The second plastic piece may be installed between the heating element 14 and the handle piece 12.

Figure 6:
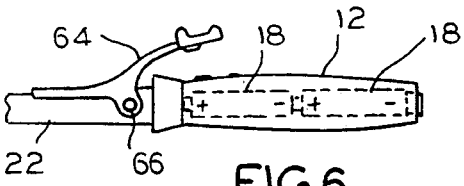
FIG. 6 is a side view of the handle of the apparatus of FIG. 1 having a battery energy source.
Figure 7:
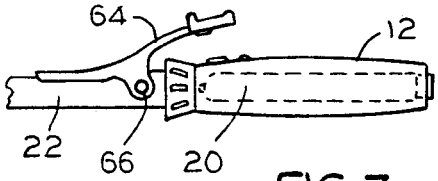
FIG. 7 is a side view of the handle of the apparatus of FIG. 1 having a gas energy source.

The heating element 14 may be any suitable material and construction which provides sufficient heat to curl hair during operation. The element could be a resistance wire inside an electrically insulating sleeve, commonly called a rope heater, a resistance wire encapsulated in ceramic material, sometimes called a ceramic heater, a positive temperature coefficient thermistor, sometimes called a PTC heater, or a gas-powered element fueled by butane or the like. A nineteen watt heating element is sufficient in some cases, although other power levels are contemplated, provided the desired temperature is reached. The power level should be sufficient to maintain a temperature of about 180° C. for professional users, and about 140°-150° C. for non-professional or home users. The element 14 may be heated by line voltage, as in FIG. 1, batteries 18 (FIG. 6), a gas source 20 (FIG. 7) or any other suitable energy source. The batteries 18 could be rechargeable, if desired, and the gas source 20 could be a disposable butane tank or the like.

A heating tube 22 (FIG. 3) in thermal contact with the heating element 14 is secured to the handle 12 and defines a hair curling mandrel about which a tuft of hair strands can be wound for curling. The tube 22 is preferably cylindrical near the handle 12, to provide strength in the tube 22 and a secure connection to the handle 12, and may have the shape shown in FIGS. 4 or 5 in the part of the tube 22 over which curls are made. The tube 22 may be made of any suitable material, but is preferably metal, such as aluminum, cold rolled steel, stainless steel or brass. Thin stainless steel about 0.02 inch thick has been found to be suitable, particularly for irons having small heating tubes about 1.2 inches in circumference, because it has sufficient strength and adequate thermal capacity. Aluminum or steel tubing 0.03–0.04 inch thick can be used in irons having a 2 inch heating tube circumference. The tube 22 may be formed from a round hollow cylinder or extruded to a desired shape.

Figure 3:
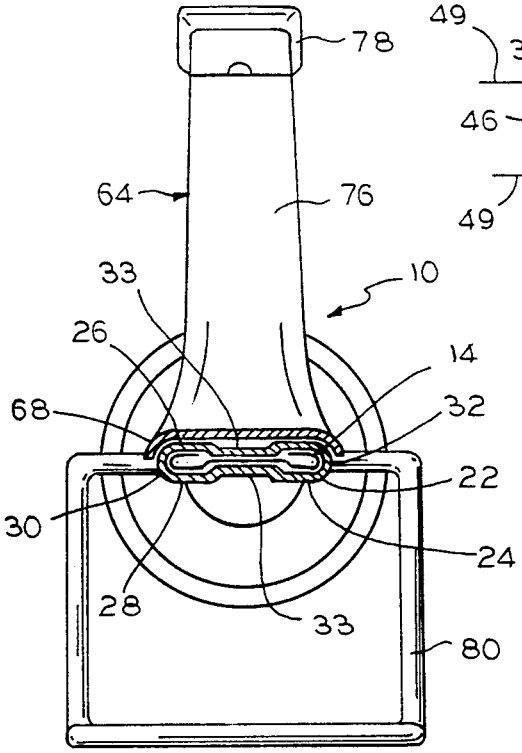
FIG. 3 is a sectional view of the apparatus of FIG. 1, taken along lines 3,4—3,4 in FIG. 2.
Figure 5:
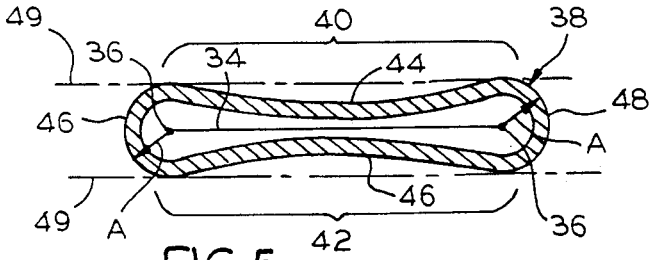
FIG. 5 is a sectional view of an alternate embodiment of the heating tube of FIG. 4.
Figure 4:
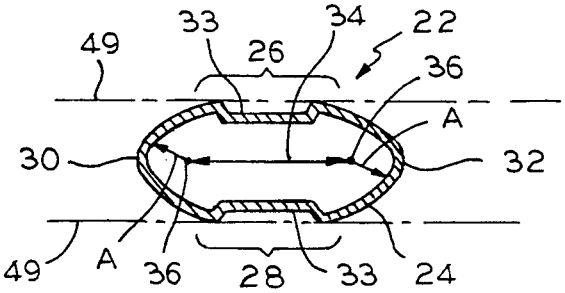
FIG. 4 is an enlarged sectional view of the heating tube of the apparatus of FIG. 1 taken along lines 3,4—3,4 in FIG. 2.

The tube 22 has a generally flattened shape, as seen in FIGS. 3, 4 and 5. The tube 22 shown in FIGS. 3 and 4 includes an outer surface 24 which has relatively wide top and bottom surfaces 26, 28 and relatively narrow, rounded side surfaces 30, 32 which join the top and bottom surfaces 26, 28.

The top and bottom surfaces 26, 28 each have a longitudinal depression 33 generally in the center of the surface, as shown in FIGS. 3 and 4, so that hair strands do not touch the tube 22 directly across the middle portions of the surfaces 26 and 28. Thus, heat is conserved within the heating tube 22, and heat transfer to the hair is focused to those portions of the hair strands where the hair is actually curled. In addition, heat energy which is stored in the depressions 33 is transferred to the sides of the tube if several curls are made quickly during use, rapidly drawing heat energy from the sides of the tube. Also, the close proximity of the depressions 33 to the heating element 14 provides improved contact and therefore improved heat transfer from the heating element 14. Thus, the depressions 33 improve the performance of the iron The depressions 33 may be depressed from the surfaces 26, 28 by at least about 0.003 inch, or any distance which somewhat thermally isolates the hair strands from the tube 80. A depression 33 of between about 0.003 inch and about 0.008 inch depth on each surface 26, 28 is preferred. The depressions 33 may only approach an end piece 50 (FIG. 1), or may extend to the end piece 50.

The side surfaces 30, 32 have a suitable radius A which can be between about 0.03 and 0.1 inch. However, it has been found that well-defined, resilient curls may be obtained with a radius A of about 0.06 inch.

Figure 10:
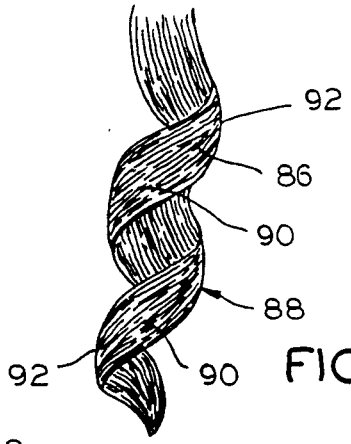
FIG. 10 is another perspective view of Z-shaped curls made in accordance with this invention.

The distance 34 (FIG. 4) between the origins 36 of the radii A is greater than the sum of the radii A so that the tube 22 creates Z-shaped curls, as shown in FIG. 10. Z-shaped curls have a plurality of substantially straight lengths 90 joined by sharp curves 92. Other appearances may be obtained by separating the curls and combing them out in various ways, selectively curling only portions of the hair, to achieve creative hair styles, as will be seen.

In an embodiment similar to that shown in FIG. 4, which was designed to make relatively small Z-shaped curls, the distance 34 between the origins 36 of the radii A was about 0.37 inch. The radii A were about 0.06 inch, and could be reduced to about 0.05 inch. The depressions 33 were depressed about 0.005 to about 0.008 inch from the surfaces 20, 28, respectively In an embodiment designed to make larger Z-shaped curls, the distance 34 (FIG. 4) between the origins 36 of the radii A was about 0.8 inch, and the radii A were about 0.06 inch. The depressions 33 were depressed about 0.005 inch from a flat plane 49 across the tops of the surfaces 26,28.

Another embodiment of the tube 22 (FIGS. 3 and 4) is shown in FIG. 5. A tube 38 has an upper surface 40, a lower surface 42 and side surfaces 46, 48. The upper and lower surfaces 40, 42 each include a concave portion 44, 46, respectively.

Figure 2:
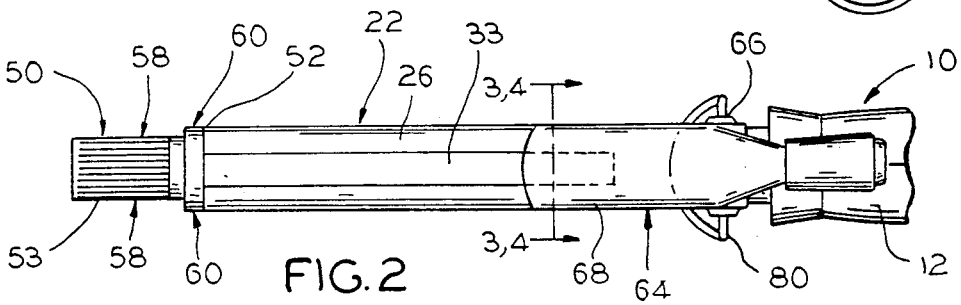
FIG. 2 is a top plan view of a portion of the apparatus of FIG. 1.

The end piece 50 (FIGS. 1 and 2) covers a distant end 52 of the tube 22. The end piece 50 is made of heat resistant plastic or the like so that the end piece 50 is cooler than the heated tube 22, and may be held between the fingers during operation.

A reduced thickness portion 53 (FIGS. 1 and 2) may be provided in on the end piece 50 to prevent the fingers from inadvertently touching the heated tube 22. The reduced portion 53 (FIG. 1) may include a reduced height 54, which may be about 0.08 inch smaller than the full height 56, and has a reduced width 58 (FIG. 2), which is preferably about 0.2 inch smaller than the full width 60.

A clamp 64 (FIG. 1) is secured to the iron 10 adjacent the handle 12 by a hinge 66. The clamp 64 includes a clamping segment 68 which extends over a portion 70 of the tube 22. Preferably the depressions 33 extend beneath the clamp 64 (FIG. 2) to reduce the flow of heat from the tube 22 to the clamp 64.

The portion 70 represents about 30% of the usable length 72 of the tube 22 in FIG. 1 which may be used for curling. If, for example, the total length 72 were about 5 inches, the portion 70 might be about 1½ inches. Other proportions up to about 50% are contemplated.

A spring 74 is provided which presses the clamping segment 68 towards the top surface 26 of the tube 22 in the absence of other forces on the clamp 64. The spring 74 may be any suitable configuration, and is preferably secured to the hinge 66 beneath the clamp 64, as shown in FIG. 1. Preferably, the clamping segment 68 presses the portions of the hair strands which touch or are close to the sides 30, 32 (FIG. 3) firmly against the tube 22, but does not press portions of the hair strands which are adjacent the top and bottom surfaces 26, 28 against the outer surface 24 of the tube 22.

The clamp 64 also includes an actuator 76 which permits the operator to lift the clamping segment 68 of the clamp 64 away from the tube 22 when desired. The actuator 76 includes a plastic end 78, and should be long enough to provide sufficient leverage so that the clamp 64 may be easily operated, and so that the end 78 does not become excessively hot during operation.

A stand 80 may be attached to the iron 10 by securing it to the hinge 66, if desired, as seen in FIGS. 1 and 3. The stand 80 may be secured for moveable operation so that it may be located out of the way (FIG. 8) or beneath the iron 10 when the operator wishes to set the iron 10 on a table or the like. The stand 80 is secured to the iron 10 to one side of the center of gravity of the iron 10, so that the handle 12 is forced down when the iron 10 is placed on a table or the like. This prevents the hot tube 22 from touching the table.

During operation, the iron 10 (FIG. 1) is connected to a power source and the heating element 14 is heated to a suitable temperature. The tube 22 is heated through thermal transfer from the element 14.

The operator raises the clamping segment 68 of the clamp 64 by pushing the actuator end 78 down while holding the handle 12. The ends 84 (FIG. 8) of a tuft of hair strands 86 are placed between the tube 22 and the clamping segment 68. Then the actuator end 78 is released. The spring 74 forces the clamping segment 68 against the portions of the hair strands 86 which are adjacent to the side surfaces 30, 32, grasping the ends 84 between the tube 22 and the clamping segment 68.

Figure 8:
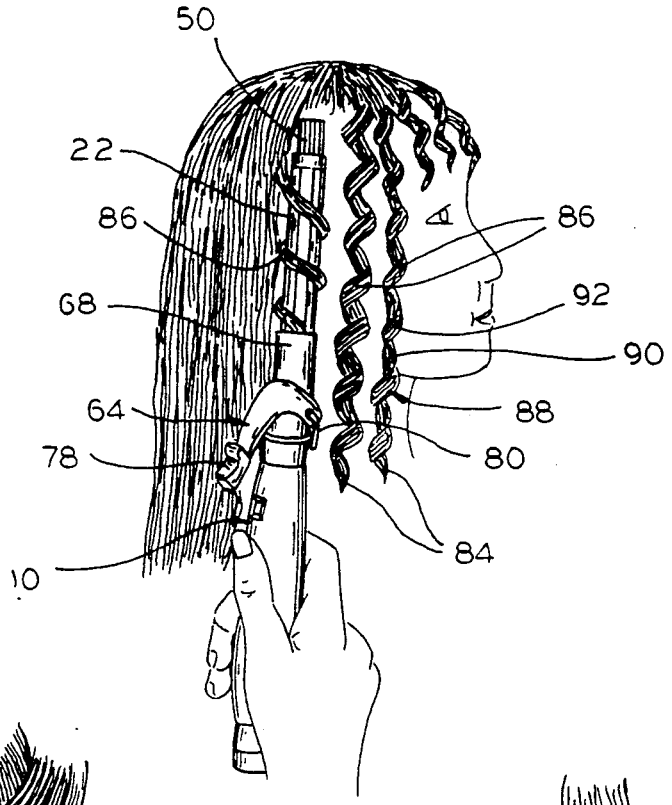
FIG. 8 is an elevational view of the apparatus of FIG. 1 in use.

Next, the rest of the hair strands 86 are wrapped around the tube 22, preferably by twirling the tube 22, so that substantially the entire length of the strands 86, except straight lengths 90, which lie over the depressions 33, touches the tube 22, without overlapping. as shown in FIG. 8. The iron may be twirled by placing the end 50 between the fingers, if desired. By twirling the iron in this manner, the hair strands are not twisted over each other with respect to the mandrel, Such twisting would create the appearance of twine. Twirling the tube in the manner suggested creates the untwisted appearance seen in FIGS. 8, 9 and 10.

Figure 9:
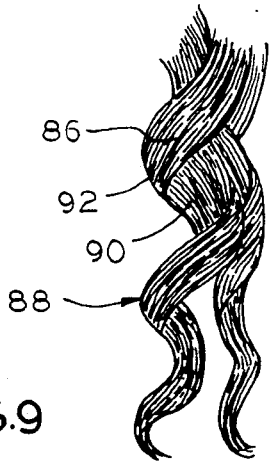
FIG. 9 is a perspective view of Z-shaped curls made in accordance with this invention.

After an acceptable period of time, the strands 86 are released by raising the clamping segment 68 and sliding the tube 22 out of the curl without disturbing the shape of the curl. The strands 86 maintain generally Z-shaped curls 88 having a plurality of relatively straight lengths 90 separated by curves 92. The curves 92 create angles between adjacent lengths 90 which are greater than 90 degrees, as seen in FIGS. 8, 9 and 10.

By helically wrapping the hair around the tube 22 without overlapping, the Z-shaped curls produced by the iron 10 generally coil in a three dimensional spiral, as shown in FIGS. 8 and 10. The curls may be combed out to create a variety of interesting appearances. The curls shown in FIG. 8 and the curls shown in FIG. 10 are in substantially the form in which they were curled around the tube 22. The curls in FIG. 9 have been combed out to increase the distance between adjacent curls, and to create multiple curls from a single curl.

The depressions in the top and bottom surfaces of the heating tube conserve heat in the tube because heat energy is not removed from the tube by the substantially straight lengths of the Z-shaped curls because those portions of the hair strands are not in substantially direct contact with the tube. It is contemplated that this result would also achieved if insulators were placed in or used in place of the depressions.

The many advantages of this invention are now apparent. Heat is transferred to hair strands which are helically wrapped around the heated tube of the iron where the hair strands are actually curled, while dissipating less heat in other portions of the hair strands which are not to be curled. In this manner, the heating tube maintains its selected operating temperature range for longer periods of time when many curls are made successively. The performance of the curling iron is also improved because heat energy which is stored in the depressions is transferred to the sides of the tube as needed. This improves the temperature recovery time of the sides of the tube when several curls are made quickly.

While in the foregoing description of the invention various features of the invention have been described in considerable detail, it is to be understood that the description is not a limitation on the scope of the claims which follow.

What is claimed is:

1. Apparatus for curling hair comprising a handle;

an elongated thermally conductive heating mandrel secured at one end to said handle in substantially axial alignment therewith, said mandrel being in heat exchange relationship with a heating element, said heating mandrel having an elongated periphery, said periphery having two narrow convex surfaces having a radius between about 0.03 and 0.1 inch and a section which connects said narrow convex surfaces to each other, said connecting section having spaced, relatively wide opposing first and second surfaces and a longitudinal depression generally in the center of at least said first surface and extending longitudinally through at least part of said connecting section, said depression being depressed between about 0.003 and about 0.008 inch from said portions of said connecting section adjacent said depression which are not depressed, and means for clamping hair strands against said mandrel, said hair clamping means being secured to said apparatus at said one end of said mandrel, whereby said hair strands create three-dimensional Z-shaped curls having a plurality of lengths which pass over said first and second surfaces, and curves between said lengths which are formed by said convex surfaces, at least a portion of said lengths having reduced thermal contact with said mandrel, so that heat is directed to the portions of said first and second surfaces adjacent said depression, and to said convex surfaces.

2. The apparatus of claim 1 wherein said depression extends longitudinally over substantially all of said connecting section.

3. The apparatus of claim 1 wherein said depression is at least 0.003 inch from the portions of said connecting section adjacent said depression which are not depressed.

4. The apparatus of claim 1 wherein said convex surfaces have a radius of about 0.06 inch.

5. Apparatus for curling hair comprising:

a handle, a single elongated thermally conductive heating mandrel secured at one end to said handle in substantially axial alignment therewith, said heating mandrel being in heat exchanged relationship with a heating element therein, said heating mandrel having sufficient length so that hair strands may be helically wrapped in a plurality of turns around said mandrel, said mandrel having two wide similar opposing surfaces joined by two convex opposing surfaces which are relatively narrow with respect to said wide surfaces, said convex surfaces each having a radius of about 0.06 inch, and means for clamping the ends of hair strands against said mandrel before said strands are helically wrapped around said mandrel, said hair clamping means including a clamping surface mounted at the handle end of said mandrel which extends across at least a portion of one of said relatively wide surfaces of said heating mandrel while exposing substantially all of said convex surfaces to direct contact with said hair strands, whereby the apparatus may be turned to helically wind said hair strands around said mandrel, without twisting said hair strands around each other or overlapping the turns of said hair strands on said mandrel, to create three-dimensional Z-shaped curls having a plurality of substantially straight lengths joined by sharp curves.

6. The apparatus of claim 5 wherein said wide surfaces are substantially flat.

7. The apparatus of claim 5 wherein said wide surfaces are convex, said heating mandrel having a transverse cross-section the general shape of an oval.

* * * * *